US006243923B1

(12) United States Patent
Hamilton

(10) Patent No.: US 6,243,923 B1
(45) Date of Patent: Jun. 12, 2001

(54) BUTTERFLY BRACKET

(76) Inventor: Kenneth B. Hamilton, 1408 Granville Rd., Westfield, MA (US) 01085

( * ) Notice: Subject to any disclaimer, the term of this patent is extended or adjusted under 35 U.S.C. 154(b) by 0 days.

(21) Appl. No.: 09/190,588

(22) Filed: Nov. 12, 1998

(51) Int. Cl.[7] ..... B65H 75/00
(52) U.S. Cl. ..... 24/16 R; 24/570; 223/88
(58) Field of Search ..... 242/400.1, 404.3, 242/405.1, 405.2; 24/66.9, 193, 197, 198, 200, 909, 910, 16 R, 570; D11/218; 223/88

(56) References Cited

U.S. PATENT DOCUMENTS

D. 97,412 * 11/1935 Putman .
673,495 * 5/1901 Cavell .
908,743 * 1/1909 Cavell .
1,887,614 * 11/1932 Alterson .
2,222,802 * 11/1940 Ragsdale .
4,193,563 * 3/1980 Vitale .
5,590,443 * 1/1997 Fildan .

* cited by examiner

*Primary Examiner*—James R. Brittain
(74) *Attorney, Agent, or Firm*—Leonard S. Michelman

(57) ABSTRACT

Two brackets having butterfly configurations with openings therein adapted to permit each end of two conventional clothes hangers to be engaged in a parallel status, provide a completed storage facility for hoses, flexible tubes, ropes, chains, belts, electric cords, christmas light cords, and other similar items to be stored thereon. Each bracket has opposite concave arms connected to opposite flat arms completing a continuous periphery to form a closed exterior bracket with openings therein. The flat arms of the bracket form an angle with the concave arms of the bracket permitting frictional engagement with the flat and diagonal members of a conventional coat hanger which are located within the openings. Each bracket engages two coat hangers, forming a storage facility between the concave surfaces of each bracket and the two side-by-side clothing hangers.

1 Claim, 3 Drawing Sheets

BUTTERFLY BRACKET

SUMMARY OF INVENTION

This invention is concerned with a novel portable storage article of manufacture for engagement with two conventional clothing hangers. The surfaces of the arms of the article form angles so as to engage a clothes hanger with a frictional connection. Two hangers and two brackets form a storage facility. There is a flat connector from each concave arm, one to the other. The bracket appears in the shape of a butterfly. The concave surfaces permit wire, rope, flexible tubes, hoses, Christmas light cords and the like to be stored and wrapped around the upper and lower concave arms of the brackets when connected to the two coat hangers.

SPECIFICATION

It is an object of the within invention to provide a simple method of using two conventional clothes hangers with two novel butterfly brackets to form a simple, uncomplicated storage facility for wire, hoses, flexible tubes, belts, ropes and the like.

It is yet a further object of this invention to provide two simple butterfly shaped brackets that are easily connected to two conventional clothes hangers to form a storage facility.

It is an additional object to provide two butterfly shaped brackets that are inexpensive to manufacture.

It is yet a further object of the invention to provide butterfly brackets that are space savers, they themselves, and are easy to store until needed to be used.

For a more detailed description of the invention, reference is made to the following detailed description, and to the drawings, in which:

FIG. 1 is a top plan view of the butterfly bracket

FIG. 1*a* is a perspective view of the butterfly bracket

Figure 1A:
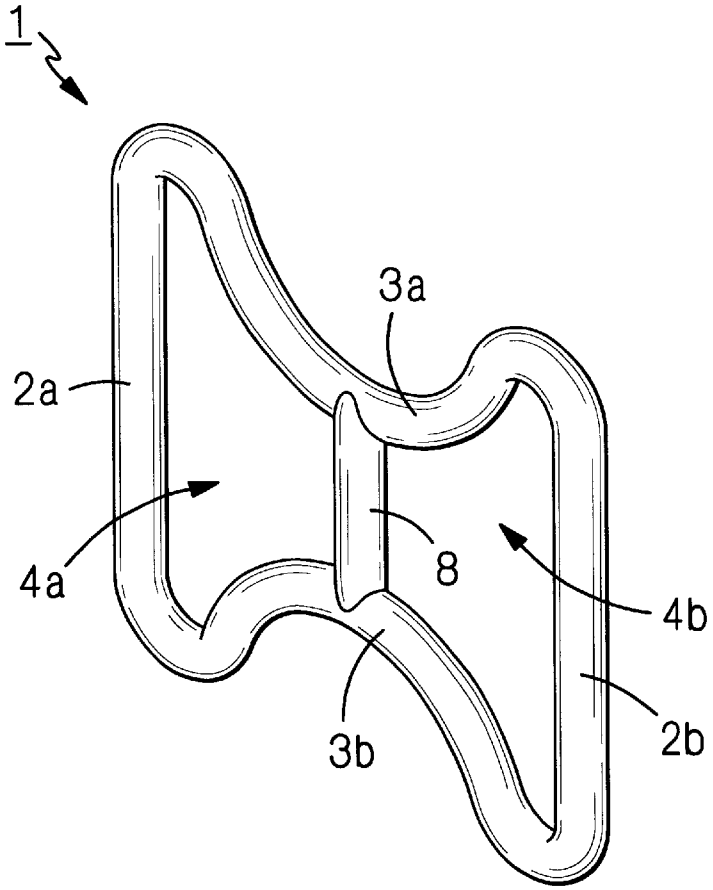
Figure 1:
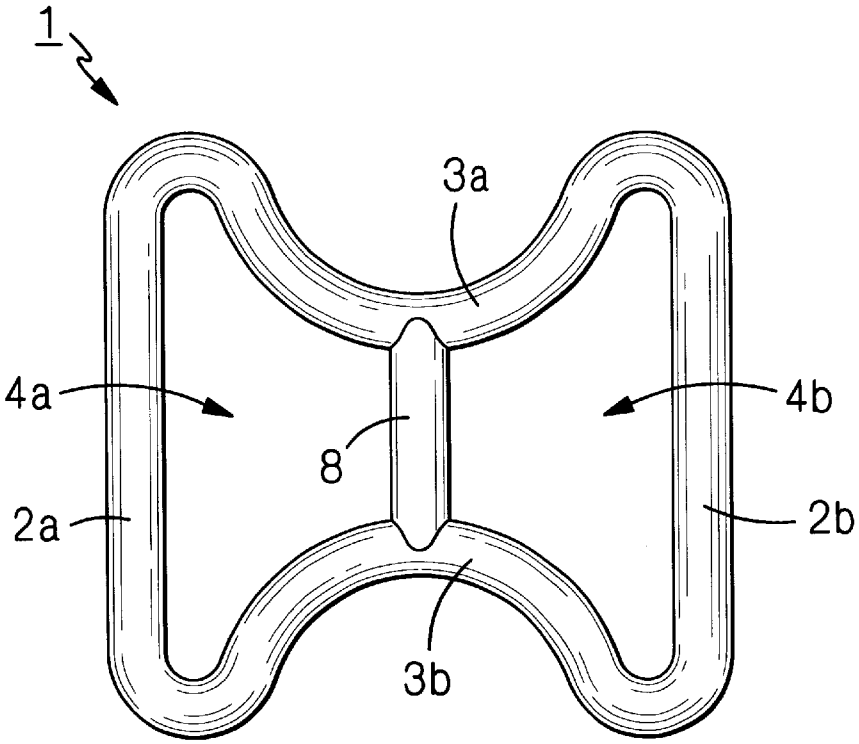

Reference is made to the views of FIGS. 1 and 1*a*, the Butterfly bracket, of the drawings. The Butterfly bracket 1 has two flat arms, 2*a* and 2*b*. Bracket 1 also has concave arms or flanges, 3*a* and 3*b*, opposite each other, and each connected to arms 3*a* and 3*b*. A butterfly shape is formed. There is an intermediate arm 8, connecting each concave arm, 3*a* and 3*b*, with each other. Arm 8 acts as a structural brace to maintain the butterfly shape, rigid.

Figure 2:
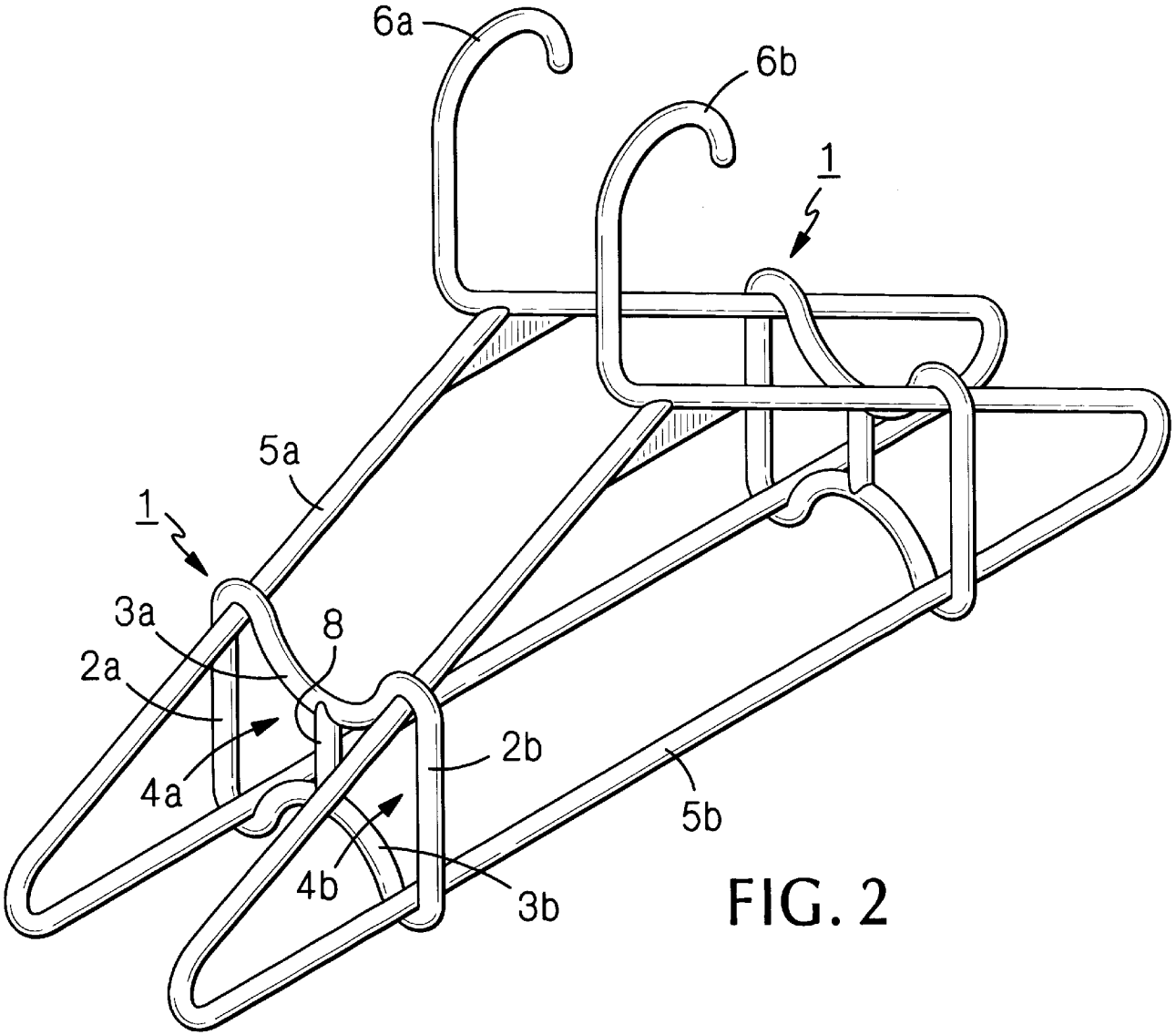
FIG. 2 is a perspective view of two of the brackets connected to two conventional clothes hangers.

Reference is now made to the clothes hangers 6*a* and 6*b* of FIG. 2. The butterfly brackets 1, engage each hanger 6*a* and 6*b* as shown. Each of two brackets are pushed up onto the diagonal arm 5*a* of hanger 6*a* and 6*b* and along the lower arm 5*b* of each hanger until the angle formed by the concave arms 3*a* and 3*b* in conjunction with the flat arms 2*a* and 2*b*, will not permit any further movement, creating a frictional fit. An open area 4*a* and 4*b* is formed by the arms 4*a*, 4*b*, 3*a* and 3*b* and the strut 8, permitting the arms 5*a* and 5*b* of each of the hangers to engage each of the butterfly brackets 1.

Figure 3:
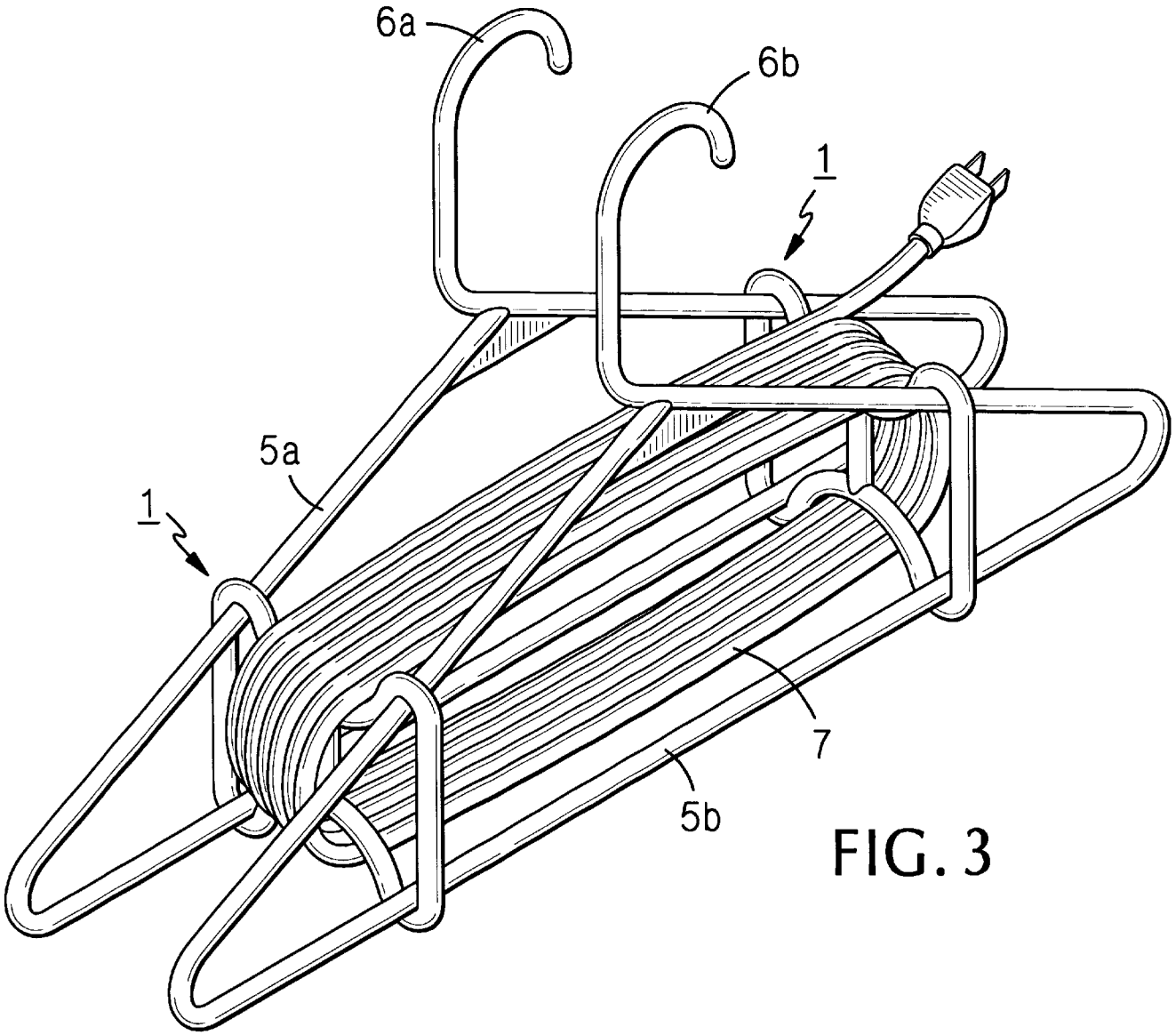
FIG. 3 is a perspective view similar to FIG. 2 with an electrical wire cord stored thereon by being wrapped around the concave arms of the butterfly brackets.

FIG. 3 shows an electrical wire cord 7, stored on the butterfly brackets that are now connected between the two parallel clothes hangers, 6*a* and 6*b*. Brackets 1, being thin and planar, can be easily placed in a drawer, when not in use, taking up little space.

I claim:

1. A pair of butterfly shaped storage brackets designed with dimensions to secure two similar triangular coat hangers including diagonal and horizontal members to provide a recessed area for storing the likes of ropes, electrical wires, and similar material, comprising of two separate brackets with arms, all of the arms of each bracket being in the same flat plane, each of said brackets having two vertical arms opposite each other, two deep concave arms opposite each other, said concave arms connected and being integral at each of its ends to each of said vertical arms, forming the outer periphery to appear as the shape of a butterfly, a cross member connecting and integral with the center of each concave arm, whereby each concave arm has a deep and acute recess angle formed with the vertical arms, both at the top and the bottom, to permit a pair of similar coat hangers to form a friction fit with its diagonal and horizontal members of the coat hangers within the said deep angle so as to form a unit whereby there is storage space located in the area created above and below the concave arms of the butterfly bracket, and also formed between the diagonal and horizontal members of the said two coat hangers so that ropes, electrical wires and the like may be stored in said area by circumscribing each of the concave arms of each bracket.

* * * * *